United States Patent [19]

McHerron

[11] 4,313,063

[45] Jan. 26, 1982

[54] AIRPORT LIGHTING SEQUENCE CONTROL

[75] Inventor: James I. McHerron, North Syracuse, N.Y.

[73] Assignee: Calocerinos & Spina, Liverpool, N.Y.

[21] Appl. No.: 83,767

[22] Filed: Oct. 11, 1979

[51] Int. Cl.[3] ..... G08G 5/06

[52] U.S. Cl. ..... 307/135; 340/26

[58] Field of Search ..... 361/3, 5, 6, 7; 307/36, 307/38, 42, 134, 135, 137, 247 A, 149, 157; 340/26

[56] References Cited

U.S. PATENT DOCUMENTS

| | | | |
|---|---|---|---|
| 2,486,198 | 10/1949 | Newstedt | 340/26 X |
| 3,152,327 | 10/1964 | Barker | 340/26 X |
| 3,531,765 | 9/1970 | Christianson et al. | 340/26 |
| 3,715,741 | 2/1973 | McWade et al. | 340/26 |
| 4,010,380 | 3/1977 | Bailer et al. | 307/10 LS |

*Primary Examiner*—L. T. Hix
*Assistant Examiner*—James L. Dwyer
*Attorney, Agent, or Firm*—Roylance, Abrams, Berdo & Farley

[57] ABSTRACT

An airport lighting system is provided with a plurality of groups of lights, each light group being assigned to a specific taxiway. The system further includes a selector switch to control a plurality of relay circuits for selecting and reselecting the light groups to be energized. Sequencing means automatically deactivates the regulated power prior to making new selections of light groups and thereafter returns the regulated power.

4 Claims, 6 Drawing Figures

RELAY SEQUENCE CONDITIONS

| COND-ITION | TIME (SEC) | LIGHTING CONTROL CIRCUIT OUTPUTS | | CC1 | RELAY | | TIME DELAY | | | | | | | | CC2 | CIRCUIT SELECTOR SWITCH | |
|---|---|---|---|---|---|---|---|---|---|---|---|---|---|---|---|---|---|
| | | CKT1 | CKT2 | | R1 | R2 | TD1 1.5 Sec. | TD2 1.5 Sec. | TD3 1.5 Sec. | TD4 1.5 Sec. | TD5 0.8 Sec. | TD6 0.8 Sec. | TD7 0.8 Sec. | TD8 0.8 Sec. | | CKT1 | CKT2 |
| A | INITIAL COND. | D | D | D | D | D | D | D | D | D | E | E | D | D | D | D | D |
| | COMMAND t=0 | E | D | E | E | D | O | D | D | O | E | E | O | D | D | D | D |
| | t+.8 | E | D | E | E | D | O | D | D | O | D | E | E | D | D | E | D |
| | t+1.5 | E | D | E | E | D | E | D | D | E | D | E | E | D | E | E | D |
| B | INIT. COND. | E | D | E | E | D | E | D | D | D | D | E | E | D | E | E | D |
| | COMMAND t=0 | E | E | E | E | E | E | D | O | D | D | E | E | O | D | E | D |
| | t+.8 | E | E | E | E | E | E | D | O | D | D | D | E | E | D | E | E |
| | t+1.5 | E | E | E | E | E | E | D | E | D | D | D | E | E | E | E | E |
| C | INIT. COND. | E | E | E | E | E | E | D | E | D | D | D | E | E | E | E | E |
| | COMMAND t=0 | D | E | E | D | E | D | O | E | D | O | D | D | E | D | E | E |
| | t+.8 | D | E | E | D | E | D | O | E | D | E | D | D | E | D | D | E |
| | t+1.5 | D | E | E | D | E | D | E | E | D | E | D | D | E | E | D | E |
| D | INIT. COND. | D | D | D | D | D | D | D | D | D | E | E | D | D | D | D | D |
| | COMMAND t=0 | D | E | E | D | E | D | O | O | D | E | E | D | O | D | D | D |
| | t+.8 | D | E | E | D | E | D | O | O | D | E | D | D | E | D | D | E |
| | t 1.5 | D | E | E | D | E | D | E | E | D | E | D | D | E | E | D | E |
| E | INIT. COND. | E | E | E | E | E | E | D | E | D | D | D | E | E | E | E | E |
| | COMMAND t=0 | E | D | E | E | D | E | D | D | O | D | O | E | D | D | E | E |
| | t+.8 | E | D | E | E | D | E | D | D | O | D | E | E | D | D | E | D |
| | t+1.5 | E | D | E | E | D | E | D | D | E | D | E | E | D | E | E | D |

FIG. 6

AIRPORT LIGHTING SEQUENCE CONTROL

This invention relates to airport runway and taxiway lighting systems and, more specifically, to improved control circuits for controlling the operation of such lighting systems.

BACKGROUND OF THE INVENTION

Control circuits for energizing airport taxiway lighting are commonly designed to include certain basic components to permit desired control and to guarantee that certain safety requirements are met. The systems and control circuits are, basically, circuits which include relays, switches and one or more regulators. While the complexity is necessarily somewhat variable depending upon the size of the airport, such lighting systems have certain basic features in common. The lighting devices themselves are connected in series and two or more such series circuits are energized from a circuit selector switch box. The switch box is supplied with current from a current regulator which is controlled by a lighting control relay unit. The appropriate circuit selection in the lighting control relay unit is actuated by switches in a terminal control panel or, alternatively, by a pilot control unit in an aircraft which actuates a pilot control relay in the ground equipment.

Except for the pilot control unit in the aircraft, the above described equipment is located at various places on the ground. Normally the terminal control switches are physically separated, in different buildings, from the lighting control relay cabinet and the other components.

It has been found that a seriously disadvantageous and possibly dangerous set of conditions can arise in the use of this equipment resulting from the fact that the current regulator must be provided with an overvoltage responsive circuit which operates circuit breakers to shut the regulator off in the event of an external open circuit. It was observed that, under some conditions, an effort to turn on a specific taxiway series lighting circuit resulted in deenergization of the entire system, particularly when one lighting circuit had previously been energized. It was then necessary for someone at the terminal to become aware of, or be advised of, the problem and to go to the regulator location to manually reset the circuit breakers. This is not only inconvenient but can, for obvious reasons, be unsafe.

It is believed that the deenergization takes place because at least some of the relay contacts, which necessarily operated in make-before-break sequence, undergo some contact bounce, creating an open circuit which, even though transitory in nature, is detected as an open circuit by the regulator protection circuit, causing the circuit breakers to open. Furthermore, because of the other safety requirements of the system and the equipment components, the nature of the relays and the regulator protection cannot be changed.

BRIEF DESCRIPTION OF THE INVENTION

An object of the present invention is to provide an improved airport lighting system which is capable of accomplishing lighting circuit switching without undesirable loss of power.

A further object is to provide a relay control circuit which is compatible with existing conventional airport lighting control equipment and can be added thereto for assuring that the circuit selector switch relays of the existing control equipment are in a predetermined initial condition from which they can be reliably changed to a desired ultimate condition without causing power loss.

Briefly described, the invention includes an airport lighting system having a plurality of groups of lights, each light group being assigned to a specific taxiway or runway, the combination comprising selector switch means for selecting and reselecting at least one light group to be energized at any time, a regulated source of power connected through said selector switch means to the selected at least one group of lights, and sequencing means for deactivating said regulated source of power prior to making a new selection of at least one light group to be energized and thereafter reactivating the source of regulated power.

In another aspect, the invention includes a sequence control apparatus for use in combination with a lighting system of the type having a source of power, a current regulator circuit connected to the source of power, a plurality of lighting circuits, selectively energizable lighting relay means for interconnecting the regulator circuit and at least one of the lighting circuits, and switch means for providing command energizing signals to said lighting relay means and a control signal to said regulator circuit to energize said lighting relay means and activate said regulator circuit and thereby energize the selected at least one lighting circuit, and wherein the regulator circuit includes means responsive to an overvoltage condition at the output thereof for opening circuit interrupting means therein, the sequence control apparatus comprising relay circuit means connected between said switch means and said regulator circuit and between said switch means and said lighting relay means, said relay circuit means being responsive to a command signal for sequentially opening the circuit for said control signal to said regulator circuit, completing after a first predetermined time interval, a power circuit to a selected one of said lighting relay means, and, after a second predetermined interval, completing the circuit for said control signal.

In order that the manner in which the foregoing and other objects are attained in accordance with the invention can be understood in detail, particularly advantageous embodiments thereof will be described with reference to the accompanying drawings, which form a part of this specification, and wherein:

FIG. 6 is a chart showing various states and conditions of the system incorporating the invention for purposes of explanation.

Figures 1, 2:
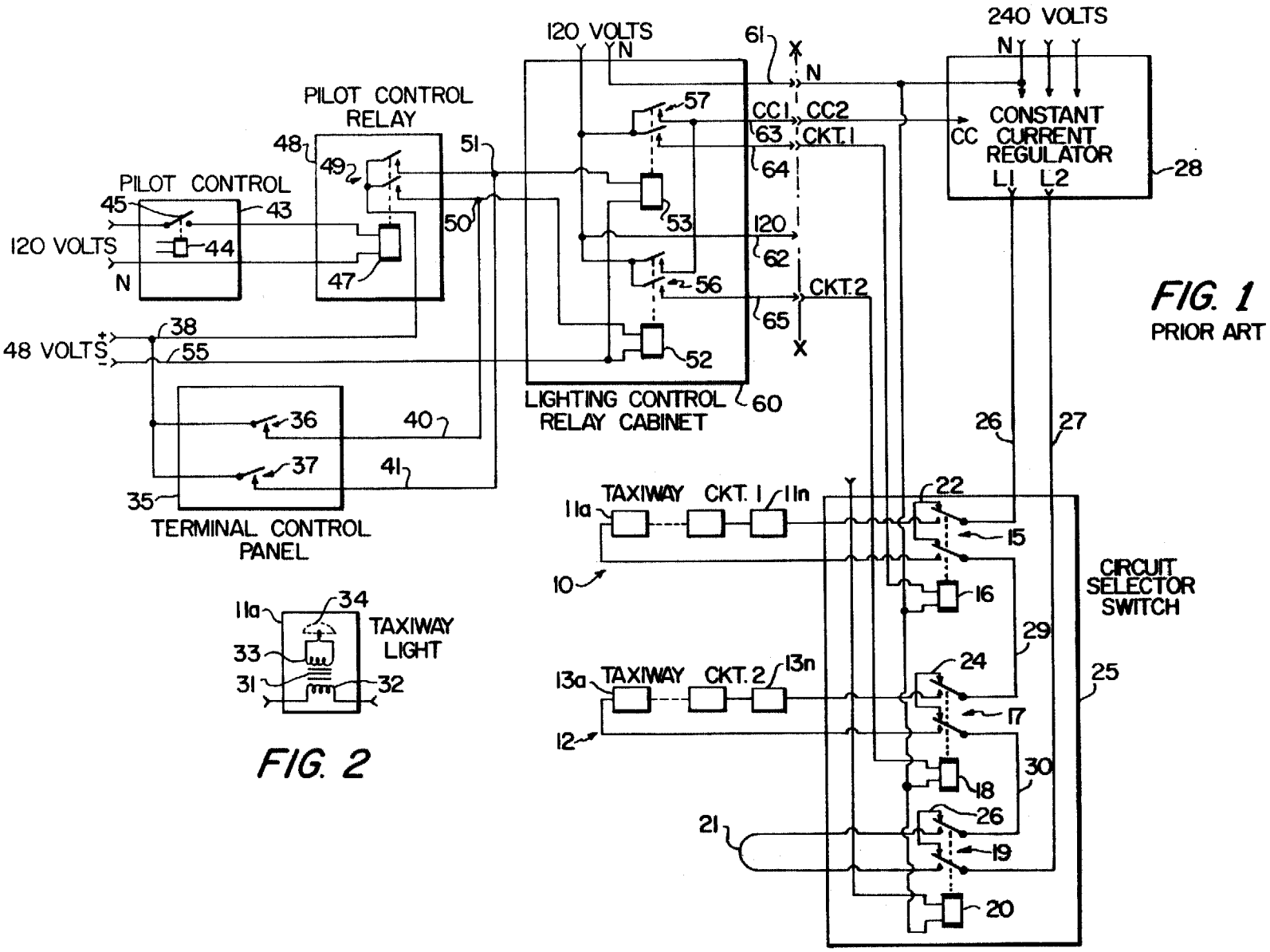
FIG. 1 PRIOR ART
FIG. 1 is a schematic circuit diagram, partly in block form, of a two circuit taxiway lighting system of conventional design, illustrating the environment for use of the present invention.
FIG. 2 is a schematic diagram of a conventional taxiway light of a type used in the system of FIG. 1.

FIG. 1 is an illustration of an existing airport lighting system which will be described for purposes of establishing, in rather general terms, the environment to which the apparatus in accordance with the invention can advantageously be applied, and also for purposes of explaining the problems which give rise to the invention. As is well known, the taxiways and runways of an airport are provided with a plurality of lighting devices which are connected in series circuit relationship with each other. These lighting devices are disposed along the edges of the paths to be followed by the aircraft during landing, taking off or taxiing to and from the runways. In FIG. 1, one lighting circuit indicated generally at 10 includes lighting devices 11*a* through 11*n*, the actual number of lighting devices in the circuit being determined by the length of the runway or taxiway. A second lighting circuit indicated generally at 12 includes series connected lighting devices 13*a*–13*n*. Lighting circuit 10 is connected to the contacts of a pair of contact sets indicated generally at 15 which are concurrently actuated by an energizing relay winding 16. Similarly, lighting circuit 12 is connected to a similar contact set 17 concurrently actuated by winding 18. A third contact set 19, operated by a winding 20, is also shown for the purposes of illustrating that a conventional system can include expansion capability but, in such case, the contact sets which would normally be connected to a lighting circuit and which may ultimately be so connected must be provided with a shunt 21. The reason for this is that the lighting circuits are not only series circuits themselves but, when connected, are connected in series circuit relationship with each other.

It will be observed from FIG. 1 that contact sets 15, 17 and 19 are double-pole, double-throw contact sets, the relays and contact sets being shown in their deenergized positions. The movable contact members are thus shown connected to the contacts which they would engage in the deenergized condition, which contacts are connected to each other by shunts 22, 24 and 26, respectively to maintain the series circuit continuity. All of these relays are contained in a unit 25 identified as a circuit selector switch unit.

Power is supplied to the contact sets and, therethrough, to the lighting circuits by conductors 26 and 27 from the outputs of a constant current regulator circuit 28. It will be observed that conductor 26 is connected to one of the movable contacts of contact set 15, that conductor 27 is connected to one of the movable contacts of contact set 19 and that, through shunts 22, 24 and 26, and through the contacts and interconnections 29 and 30 therebetween, a continuous series circuit exists between output terminal L1 and L2 of the regulator 28. Furthermore, it will be observed that if any one of relay windings 16, 18 or 20 is energized, continuity of the series circuit is maintained through either lighting circuit 10 or 12 or through shunt 21.

For purposes of completeness, FIG. 2 illustrates schematically the arrangement for one such taxiway light 11*a*. It will be seen that each such taxiway light includes a transformer 31 having a primary winding 32 connected in series in the series circuit 10 and a secondary winding 33 which is connected to the lamp 34 itself. The reason for this arrangement is to maintain continuity through the lighting device even in the event of burnout of lamp 34. The details of the lamp 34 and the transformer are of no particular consequence to the present invention and will not be further described.

Control for the lighting circuits is initiated in either a pilot control unit or a terminal control panel. As shown in the simplified schematic of FIG. 1, the terminal control panel 35 includes manually operable switches 36 and 37 which are connected to a source of power at conductor 38, shown as a 48 volt source. Closing of either switch 36 or 37 thus supplies power to respective conductors 40 and 41.

The pilot control unit 43 is shown as including a relay 44 having a contact set 45 which is connected in series in one side of a 120 volt supply. Winding 44 is energized from apparatus, not shown, including a receiver capable of receiving a radio signal from an aircraft cockpit so that the pilot himself can activate the lighting systems. In the embodiment shown, the pilot selection is more limited than the terminal control selection in that energization of the pilot control relay necessarily activates all lighting circuits.

The circuit including switch 45 is connected to a relay winding 47 in a pilot control relay unit 48. Winding 47 actuates contact sets indicated generally at 49, these contact sets being double-pole, single-throw contact sets, the movable contacts of which are connected to conductor 38 at the 48 volt supply. The fixed contacts of contact set 49 are connected to conductors 40 and 41 at junctions 50 and 51, respectively, these junctions being connected, respectively, to terminals of relay windings 52 and 53, the other terminals of both of those windings being connected to conductor 55 at the other terminal of the 48 volt supply. Winding 52 operates a double-pole, single throw contact set indicated generally at 56 and winding 53 operates a similar contact set 57. The movable contacts of both of sets 56 and 57 are connected to one terminal of a 120 volt supply. Relays 52 and 53 and their associated contact sets are contained in a lighting control relay cabinet 60. It will be noted that the other conductor of the 120 volt supply, the neutral conductor, is shown as simply passing through the lighting control relay cabinet, emerging as conductor 61. Also, a conductor 62 of the 120 volt supply emerges from that cabinet, along with conductors 63, 64 and 65. Conductor 63 is connected to one fixed contact of each of contact sets 56 and 57 and, when those contacts are closed by energization of the associated relay windings, a 120 volt supply appears on conductor 63. Conductors 64 and 65, respectively, are connected to the other fixed contacts of those two contact sets and similarly are supplied with 120 volts when the contact sets are closed. Conductor 63 is identified as the CC1 signal while conductors 64 and 65 are identified as the CKT1 and CKT2 conductors, respectively.

In FIG. 1, the conductors thus far described extend up to a dash-dot line X—X. This line is significant to insertion of the apparatus of the present invention and will be described in connection therewith. For the moment, that line will be ignored, and the connections as shown will be described.

Conductors 61 and 63 extend to the constant current regulator, conductor 61 being a neutral line which is connected to the power input to the constant current regulator which is a source of electrical power, normally 240 volts. Conductor 63 carries a command signal to activate the regulator and permit it to produce an output signal on conductors 26 and 27, previously described. The CKT1 and CKT2 signals on conductors 64 and 65, respectively, are connected to the circuit selector switch unit 25, the CKT1 signal being connected to one terminal of relay 16 and the CKT2 signal being connected to one terminal of relay winding 18. The other terminals of these windings, as is the case with winding 20, are connected to neutral conductor 61.

Thus, if a CKT1 signal is supplied, as a result of closing contact set 57, relay 16 will be energized. If the CKT2 signal is supplied as a result of closing contact set 56, relay 18 will be energized. Obviously, if both contact sets are closed, both relays will be energized and, when so energized, the contact sets operated thereby will be closed and current will be supplied by the constant current regulator to the lighting circuits.

The constant current regulator itself is a standard type of unit produced in accordance with industry and government specifications. The reason for using a constant current regulator, as well as the reason for using series circuits for the lights themselves, is to guarantee that the lights will have uniform brightness and that the brightness will not be a function of the length of the runway or taxiway, nor will it be a function of the number of lighting devices installed therein. As will be recognized, an open circuit at the output of the constant current regulator results in an increase of voltage as the regulating circuits therein attempt to raise the current in response to the greatly increased (substantially infinite) resistance. It is conventional to include in such regulators a voltage responsive circuit which reacts to an open circuit condition of this type by opening circuit breakers, thereby disabling the regulator. The breakers and the control circuits of the regulator itself are conventional and are therefore not illustrated.

As previously indicated herein, conditions of contact bounce which occur when a change in lighting circuit energization is taking place temporarily cause such an open circuit condition and commonly disable the regulator at an undesirable time. One such circumstance under which this occurs can be considered if it is assumed that relay 53 is energized, providing a CKT1 signal to energize relay 16, thereby illuminating lighting circuit 10. If switch 36 is then closed, causing energization of relay 52 and providing a CKT2 signal, contacts at 17 moves from the position shown to the position in which lighting circuit 12 is included in series with lighting circuit 10. Contact sets 15 and 17 are conventionally made to be make-before-break contact sets so that, theoretically, an open circuit condition should not occur while the contact set is switching from one position to the other. However, if the movable portions of the contact sets bounce away from the fixed contacts after the switching occurs, an open circuit condition can exist in a transient sense. This is the condition which causes the regulator to be disabled, and the circumstances commonly arise whenever the lighting systems are being switched from one condition to another.

Figure 3:
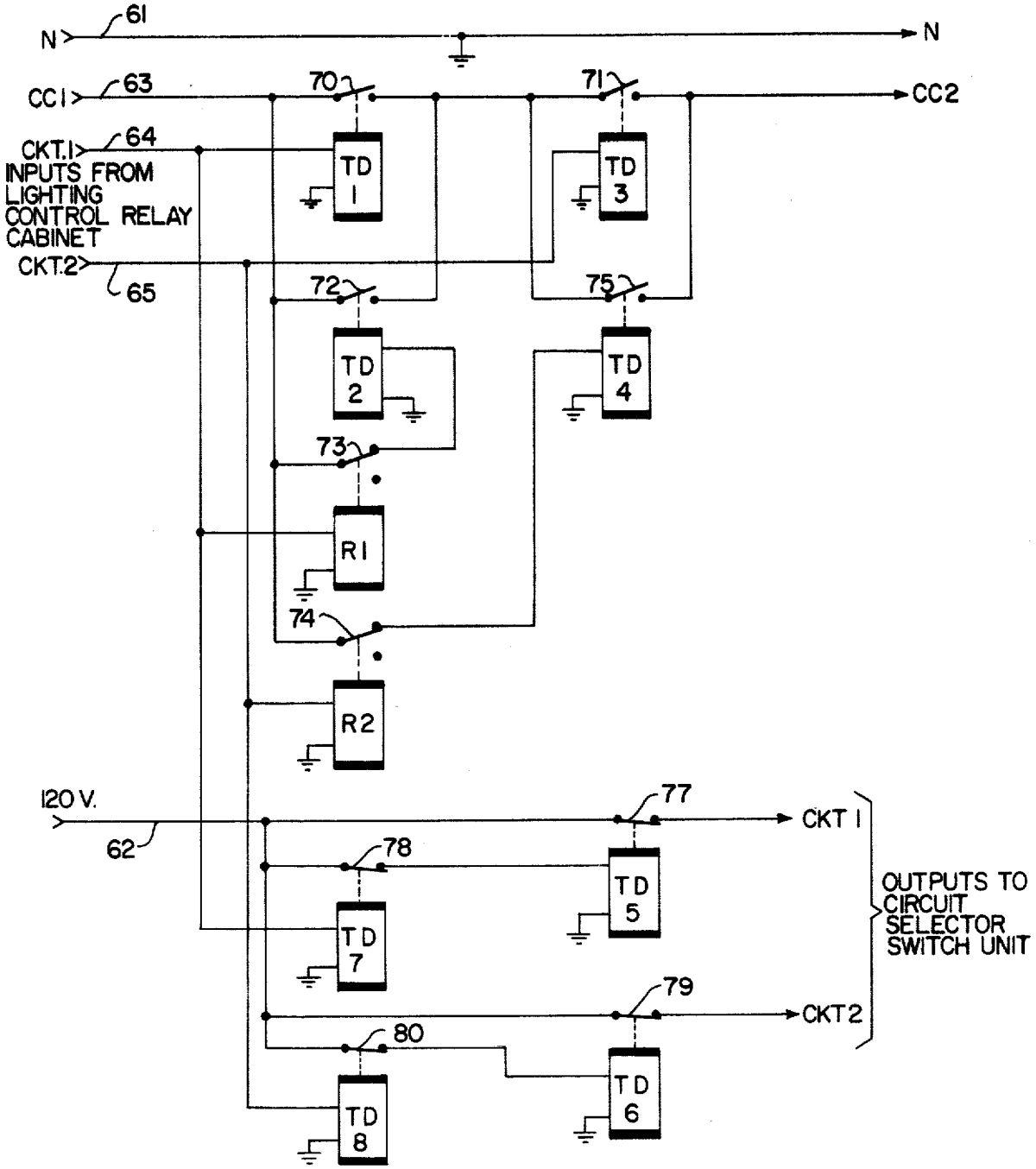
FIG. 3 is a schematic circuit diagram of an apparatus in accordance with the invention, the embodiment shown being connectable in the circuit of FIG. 1.

In order to overcome this difficulty, the sequencing apparatus in accordance with the invention is inserted at the location indicated by line X—X in FIG. 1. A circuit suitable for this purpose is shown in FIG. 3. It is important to note that this circuit can be installed in the X—X location without altering the existing equipment in any way and without the necessity for entering any of the components except for the lighting control relay cabinet to bring out an extra 120 volt conductor, shown in FIG. 1 as conductor 62. Indeed, the circuit can commonly be incorporated in the lighting control relay cabinet or attached thereto.

As seen in FIG. 3, neutral conductor 61 is connected to ground in the sequencing circuit. Conductor 63, which carries the CC1 signal, contains contact sets 70 and 71 which are normally open switches connected in series circuit relationship. To distinguish between the command signals as they are supplied to this unit and as they emanate from the unit, the output of the circuit of FIG. 3 is designated CC2. However, it will be recognized that this represents a signal which does not necessarily exist at the same time as CC1, but is, essentially, the same signal, constituting a command signal for the constant current regulator to activate that regulator.

Contact set 70 constitutes a normally open switch which is actuated by a time delay relay TD1 and contact 71 is similarly a normally open relay operated by a time delay relay TD3. Signal CC1 is also connected to one side of a normally open contact set 72, the other terminal of which is connected to conductor 63 on the other side of switch 70. Signal CC1 is also supplied to one side of a normally closed contact set 73 which is operated by a relay R1 which is not a time delay relay, the other side of this contact set being connected to the energizing winding of relay TD2. A signal CC1 is also supplied to one side of a contact set 74 which is operated by a relay winding R2, the other side of contact set 74 being connected to the energizing winding of a time delay relay TD4. TD4 operates a normally open contact set 75 which is connected in parallel circuit relationship with contact set 71.

The CKT1 signal is supplied to the energizing winding of relay TD1, to the energizing winding of relay R1 and to the energizing winding of a time delay relay TD7. Conductor 65, carrying signal CKT2, is connected to the energizing winding of relay TD3, to the energizing winding of relay R2 which operates contact set 74, and to the energizing winding of a time delay relay TD8. The 120 volt line, conductor 62, is connected through a normally closed contact set 77 which, when the contact set is closed, becomes the output CKT1 signal to unit 25. Conductor 62 is also connected through a normally closed contact set 78 to the energizing winding of a time delay relay TD5 which operates contact set 77. Contact set 78 is operated by TD7. The 120 volts from conductor 62 is also connected through a normally closed contact set 79, operated by a time delay relay TD6, and, when the contact set is closed, becomes the output signal CKT2 to unit 25. Finally, the 120 volts is connected through a normally closed contact set 80, operated by time delay relay TD8, to the energizing winding of a time delay relay TD6 which operates contact set 79.

Time delay relay TD1, TD2, TD3 and TD4 are all selected to have a significantly longer delay interval than relays TD5, TD6, TD7 and TD8. In the embodiment shown, relays TD1–4 have a delay of 1.5 seconds, while relays TD5–8 have a delay of 0.8 seconds. All of the relays are, as in the previous drawings, shown in their deenergized positions.

The operation of the circuit of FIG. 3 can be understood in conjunction with the circuit of FIG. 1 by assuming an initial set of conditions in which the 120 volt supply on conductor 62 is present on conductor 62, but that there is no regulator activating signal CC1 and, therefore, no signal CC2; and that there are no CKT1 or CKT2 signals. Under these conditions, all of relays TD1–4, R1, R2, TD7 and TD8 will be deenergized. Because of the presence of the 120 volt signal on conductor 62 and the fact that contact sets 78 and 80 are closed, after an interval of 0.8 seconds, contacts 77 and 79 will be opened by relays TD5 and TD6, respectively, eliminating the output signals CKT1 and CKT2 at the outputs of the circuit of FIG. 3.

It will then be assumed that switch 37 in the terminal control panel 35 is closed for the purpose of energizing the lights in lighting circuit 12. This will provide an output on conductor 41, energizing relay 53 in unit 60. The resulting closing of contact set 57 will supply a CC1 signal on conductor 63 and a CKT1 signal on conductor 64. The CC1 signal cannot go beyond contact sets 70 or 72 initially because those contact sets are open, but the CC1 supply is delivered to the energizing winding of time delay relay TD4 through contact set 74, beginning the 1.5 second timing interval of that relay. The CKT1 signal is delivered to relay R1, opening contact set 73 so that the CC1 signal is not supplied to the energizing winding of TD2. The CKT1 signal is also supplied to the energizing winding of relay TD7, beginning the timing interval of that relay.

After an interval of 0.8 seconds, relay TD7 is energized, opening contact set 78 and deenergizing relay TD5. This permits contact set 77 to close and supplies a CKT1 signal out of the circuit of FIG. 3 to energizing winding 16 in unit 25. This switches contact set 15 and connects lighting circuit 10 across the output of regulator 28. Then, after the expiration of the 1.5 second time interval (an additional 0.7 seconds) both of relays TD1 and TD4 are energized, closing contact sets 70 and 75. This completes the circuit between the CC1 input, the circuit of FIG. 3 and the CC2 output thereof, providing an activating signal to regulator 28, causing the regulator to deliver a constant current supply to the lighting circuit and illuminating that circuit.

As will be recognized, the interval of 0.7 seconds between the delivery of the CKT1 signal and the delivery of the regulator supply to circuit 25 is fully adequate to permit any contact bounce to have passed by. Thus, contact set 15 is securely in its new position by that time, and there is virtually no possibility of an open circuit condition arising from such circumstances existing any longer.

Carrying the operation one step further, if it is not desired to additionally energize lighting circuit 12, switch 36 in unit 35 is closed, providing a signal on conductor 40 which energizes winding 52 in unit 60 and closes contact set 56. This provides a CKT2 signal to the circuit of FIG. 3, the CKT1 signals and CC1 signals still being supplied. As previously indicated, it is this kind of condition which has previously given rise to problems in a system not including the circuit of FIG. 3.

As soon as the CKT2 signal is supplied to the circuit of FIG. 3, relay R2 is energized. This opens contact set 74, immediately deenergizing relay TD4 and removing the regulator activating signal CC2. Thus, the regulator is turned off and power is no longer supplied to lighting circuit 10. The CKT2 signal also initiates the 1.5 second interval of relay TD3 and initiates the 0.8 second interval of relay TD8. It will be observed that the CKT1 signal output of FIG. 3 is not disturbed. At the conclusion of the 0.8 second interval, relay TD8 is energized, opening contact set 80 which immediately deenergizes relay TD6, permitting contact set 79 to close, thereby providing a CKT2 output from the circuit of FIG. 3. After an additional 0.7 seconds, relay TD3 is energized, closing contact set 71 and again providing a CC2 signal output to reactivate the regulator. As will be recognized, the provision of the CKT2 signal upon closing of contact set 79 energizes relay 18 and closes contact set 17, putting circuit 12 in series with the output of the regulator and circuit 10. Then, after a 0.7 second interval during which contact bounce disappears, the CC2 signal is again supplied to the regulator by contact set 71, reactivating the regulator and energizing both of circuits 10 and 12.

The foregoing discussion has treated only two kinds of circumstances in which relays can be energized and deenergized, and it will be recognized that numerous other permutations of condition sequences can exist. These various conditions are illustrated in FIG. 6 which is a tabulation of five different sets of conditions and the events which occur as a result of those initial conditions and commands which are supplied. The relays and time delay relays are identified in FIG. 6 in accordance with the identification of FIG. 3, as are the CKT1, CKT2, CC1 and CC2 signals. It does not appear to be necessary to discuss each entry on this table, but it will be noted that the letter D is used to indicate that a signal or relay is deenergized; the symbol O is used to indicate that a time delay relay is energized at that time; and the symbol E is used to indicate that a component or relay is energized or that a time delay relay has timed out and has transferred the contact operated by that relay. By the use of this table, the operation of the circuit can be followed without difficulty.

Figure 4:
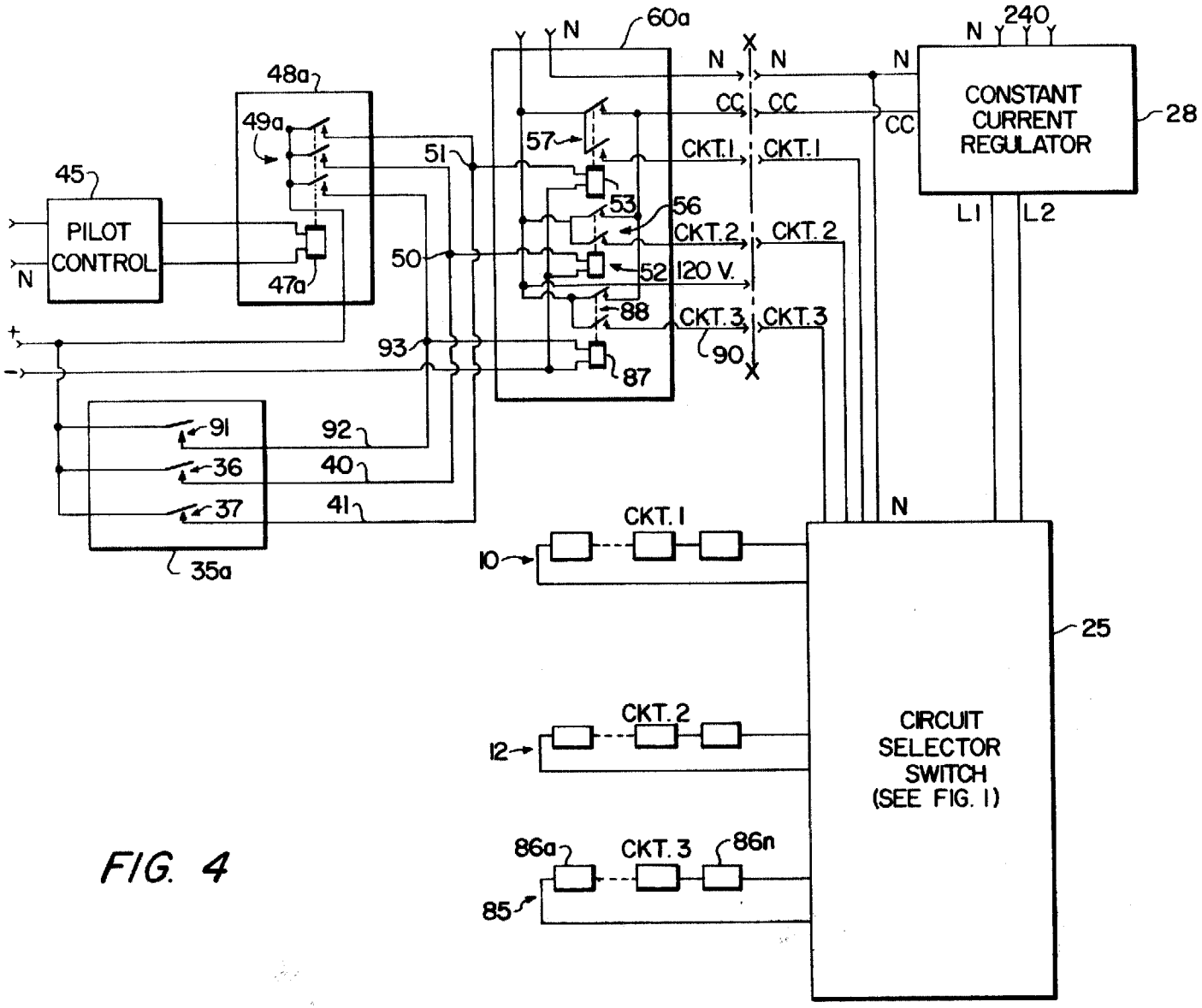
FIG. 4 is a schematic circuit diagram, partly in block form, of a three circuit taxiway lighting system of conventional design.
Figure 5:
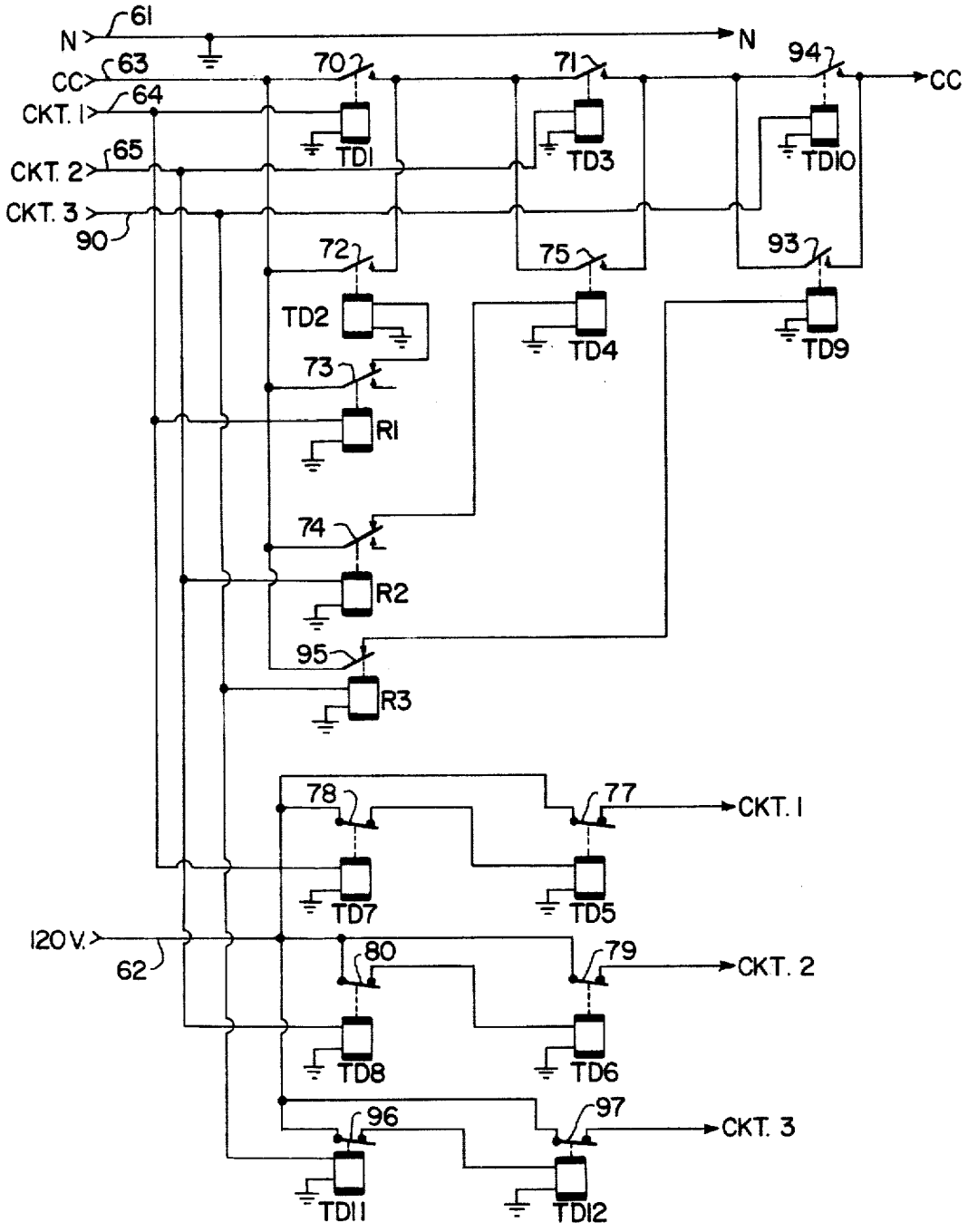
FIG. 5 is a schematic circuit diagram of a further embodiment of an apparatus in accordance with the invention for use with the system of FIG. 4.

Thus far, the discussion of the invention has related only to the operation of two lighting circuits, but it will be recognized that three or more lighting circuits can be operated by a system designed on exactly the same principles. To illustrate the manner in which this is accomplished, reference is made to FIGS. 4 and 5 which illustrate the conditions present in a system which includes three lighting circuits to be energized. Again, FIG. 4 shows an existing system having three lighting circuits but without the circuit according to the invention. FIG. 5 is similar to FIG. 3 in that it shows a circuit in accordance with the invention designed to provide proper sequential operation of the regulator and circuit selector relays to prevent undesired disabling of the regulator circuit in the system of FIG. 4.

Units 45, 28 and 25 of FIG. 4 are identical to those in FIG. 1 except for the fact that, in FIG. 4, shunt 21 has been replaced by a third lighting circuit 85 having lighting units 86*a–n* connected in series circuit relationship. Unit 48*a* similar to unit 48 of FIG. 1 except that the relay 47*a* operates a contact set 49*a* having three sets of contacts rather than two. Unit 60*a* includes relays 52 and 53 and contact sets 56 and 57 operated thereby, and also includes a relay 87 which operates a double pole, double throw contact set 88. One of the outputs of contact set 88 is a CKT3 signal on a conductor 90 which is connected to relay 20 in unit 25, relay 20 being shown in FIG. 1 with contact set 19 connected to switch circuit 85 into series circuit relationship across the regulator in the same manner as shunt 21 was available for such connection in FIG. 1.

Unit 35*a* still includes switches 36 and 37, as before, and further includes a switch 91 connected to a conductor 92 which is connected to a junction 93 to provide a signal for energizing relay winding 87. It will be apparent that the third contact of contact set 49*a* is connected to junction 93.

The operation of the circuit of FIG. 4 need not be described in great detail. It will be recognized that closing the appropriate one of switches 36, 37 or 91 energizes the associated relay 52, 53 or 87, providing a signal CKT2, CKT1 or CKT3, respectively, and that any two or all three of these switches and relays can be energized concurrently or séquentially.

Turning now to FIG. 5, it will be seen that conductors 61–65 are provided to the input of the circuit of FIG. 5 in the same fashion as in the circuit of FIG. 3, and that time delay relays TD1-TD4 and TD5-TD8 are connected in a manner identical to that of FIG. 3. Similarly, relays R1 and R2 are connected as before. Thus, these relays and their connections need not be described further. The additions to FIG. 5 as compared with FIG. 3 include a relay TD9 and a relay TD10 which are 1.5 second time delay relays operating normally open contact sets 93 and 94, respectively. The winding of relay TD10 receives an energizing signal CKT3 on conductor 90. Contact set 93 is connected in parallel circuit relationship with contact set 94 and the energizing signal for relay TD9 is supplied through a normally closed contact set 95 which is connected to receive the CC1 signal on conductor 63. The winding of relay R3 is energized by a CKT3 signal on conductor 90. In the lower portion of FIG. 5, the added circuit components are time delay relays TD11 and TD12 which operate normally closed contact sets 96 and 97, respectively. Contact sets 96 and 97 are connected to the 120 volt supply in exactly the same fashion as contact sets 78 and 77 and contact sets 80 and 79. The energizing winding of relay TD11 is connected to the CKT3 signal on conductor 90, and the winding of relay TD12 is connected to receive the 120 volts through contact set 96.

It does not appear to be necessary to discuss in detail the operation of any of the previously discussed circuit components, and the operation of the added components is substantially the same as those previously described. It will be assumed that switches 36 and 37 have previously been closed, energizing lighting circuits 10 and 12, and that it is now desired to energize circuit 85. Accordingly, switch 91 is closed, energizing relay 87, closing contacts at 88, and providing a CKT3 signal on conductor 90. That signal immediately energizes relay R3, opening contact set 95 and removing the CC1 signal from relay TD9, thereby immediately deenergizing that relay and opening contact set 93. Also, the CKT3 signal is supplied to relay TD10, beginning the 1.5 second time delay interval of that relay. At the same time, the CKT3 signal is supplied to the winding of relay TD11, initiating the 0.8 second interval of that relay. Opening of contact set 93 removes the CC2 signal, temporarily deactivating the regulator. After 0.8 seconds, relay TD11 operates, opening contact set 96 and deenergizing the winding of relay TD12, permitting contact set 97 to close and providing a CKT3 signal to relay 20 in unit 25, thereby connecting circuit 85 in series with circuits 10 and 12 across the regulator. After an additional 0.7 second delay, winding TD10 closes contact set 94, restoring the CC2 signal to the regulator and reactivating the regulator, illuminating circuits 10, 12 and 85.

It will be apparent that a chart similar to FIG. 6 could be supplied for the circuit of FIG. 5, but such does not appear to be necessary in view of the incorporation of the same principles as those applied to FIG. 3.

For the sake of completeness, it will be noted that a constant current regulator identified as a Model L-812 regulator is available in the market from the Sepco Division, Connecticut International Corporation, Windsor Locks, Conn. 06096. The regulator supplied by this corporation for use in airport lighting systems is a solid state device having a brightness control and having an open circuit condition sensor which operates as described herein.

While certain advantageous embodiments have been chosen to illustrate the invention it will be understood by those skilled in the art that various changes and modifications can be made therein without departing from the scope of the invention as defined in the appended claims.

What is claimed is:

1. An airport lighting system having a plurality of groups of lights, each light group being assigned to a specific taxiway, runway or navigational aids, the combination comprising a plurality of relay circuit means for selecting and reselecting at least one light group to be energized at any time by activation of ones of said relay circuit means operatively associated with the selected at least one light group;

selector switch means for controlling said relay circuit means;

a regulated source of power connected through activated ones of said relay circuit means to the selected at least one group of lights; and sequencing means responsive to said selector switch means for automatically deactivating said regulated source of power prior to making a new selection of at least one light group to be energized, activating the ones of said relay circuit means operatively associated with the new selection, and thereafter reactivating the source of regulated power.

2. A sequence control apparatus for use in combination with a lighting system of the type having a source of power, a current regulator circuit connected to the source of power, a plurality of lighting circuits, a plurality of selectively energizable lighting relay means for interconnecting the output of the regulator circuit and at least one of the lighting circuits, and switch means for providing command energizing signals to said lighting relay means and a control signal to said regulator circuit to energize said lighting relay means and activate said regulator circuit, respectively, and thereby energize the selected at least one lighting circuit, and wherein the regulator circuit includes means responsive to an open circuit condition at the output thereof when said regulator is activated for disabling the regulator circuit, the sequence control apparatus comprising first logic circuit means connected in a control signal circuit said switch means and said regulator circuit for selectively providing said control signal to said regulator circuit; and second logic circuit means connected between said switch means and said lighting relay means for selectively providing activating signals to said lighting relay means, said first and second logic means being responsive to a command signal from said switch means for sequentially opening said control signal circuit to remove said control signal from said regulator circuit, completing at least a portion of said second logic circuit means for a power circuit to at least a selected one of said lighting relay means after a first predetermined time interval, and, after a second predetermined time interval, completing said control signal circuit to restore said control signal to said regulating circuit.

3. An apparatus according to claim 2 wherein said first logic circuit means includes first relay means for responding to a command signal to open the control signal circuit delivering the control signal to said regulator circuit, thereby first deactivating said regulator circuit;

and wherein said second logic circuit means includes second relay means for energizing at least a selected one of said lighting relay means after said first predetermined time interval following said command signal; and third relay means for recompleting the control signal circuit delivering the control signal to said regulator circuit after said second predetermined interval, thereby activating said regulator circuit after said at least one lighting circuit has been connected to the output thereof.

4. An apparatus according to claim 3 wherein each of said lighting circuits includes a plurality of lighting devices connected in series circuit relationship, and each of said lighting relay means includes a pair of contact sets having two positions for connecting, in one position, said regulator circuit output to a lighting circuit and, in the other position, to a shunt between one contact of each of said pair of contact sets.

* * * * *